US005165146A

United States Patent [19]

O'Keefe

[11] Patent Number: 5,165,146

[45] Date of Patent: Nov. 24, 1992

[54] CLIP FOR CLAMPING ADJOINING FLAT-BLADED HELICAL COILS

[75] Inventor: Dennis J. O'Keefe, Evanston, Ill.

[73] Assignee: Stanley/Hartco the Stanley Works, New Britain, Conn.

[21] Appl. No.: 749,428

[22] Filed: Aug. 23, 1991

[51] Int. Cl.[5] ..... B65D 63/06

[52] U.S. Cl. ..... 24/20 R; 24/20 CW; 24/23 W

[58] Field of Search ..... 24/20 R, 20 W, 20 CW, 24/20 TT, 23 R, 23 W

[56] References Cited

U.S. PATENT DOCUMENTS

| | | | |
|---|---|---|---|
| 1,254,571 | 1/1918 | Bosworth | 24/20 R |
| 1,853,891 | 4/1932 | Birkenmaier | 24/23 W |
| 2,691,198 | 10/1954 | Flood | 24/23 W |
| 2,976,592 | 3/1961 | Christin | 24/23 W |
| 3,032,184 | 5/1962 | Kuster | 24/23 W |
| 3,237,255 | 3/1966 | Stanton | 24/23 W |
| 3,604,065 | 9/1971 | Slominski | 24/23 R |
| 4,087,889 | 5/1978 | Ohba et al. | 24/20 CW |
| 4,508,220 | 4/1985 | Pearson | 24/20 W |
| 4,648,158 | 3/1987 | West | 24/20 CW |

*Primary Examiner*—Victor N. Sakran
*Attorney, Agent, or Firm*—Dvorak and Traub

[57] ABSTRACT

A U-shaped clip having leg parts disposed outwardly from a crown on either side of a central axis, the leg parts having a configuration for intermeshing with each other during a clinching operation. The crown, on the interior thereof, is provided with a locking rib which extends transversely of the crown, the locking rib providing a planar surface which maintains abutting or adjoining metal tapes in a rigid position to prevent longitudinal and transverse movements between the metal tapes.

3 Claims, 1 Drawing Sheet

CLIP FOR CLAMPING ADJOINING FLAT-BLADED HELICAL COILS

BACKGROUND OF THE INVENTION

1. Field of the Invention

This invention relates to a U-shaped clip for joining together two or more elongated metal members, and more particularly for joining together adjoining helical coils.

2. Description of the Prior Art

U-shaped clips are well known. For example, U-shaped clips have been described in U.S. Pat. Nos. 3,613,878 and 4,508,220. These clips, however, have been used primarily for joining together wire members which are formed into spiral springs and attached to perimeter wire members to provide bedsprings and other furniture articles using seating. The main function of the clips is to hold together wire members without any regard of movement between the two members being clipped together. However, such clips do not perform satisfactorily in joining together adjoining elongated members, such as steel tapes or other elongated members having a rectangular cross-section, the bight portion of the clip not being capable of maintaining the tapes in uniform alignment.

SUMMARY OF THE INVENTION

The main object of the invention is to provide a U-shaped clip with a locking rib transversely traversing the bight of the clip to provide a parallel alignment of spaced or adjacent lateral edges of adjoining pairs of tapes.

A further object of the invention is to provide a U-shaped clip having a locking rib extending transversely across the bight on the inside of the clip for maintaining a parallel arrangement of lateral edges of two adjoining or spaced tapes.

A further object of the invention is to provide a U-shaped clip having opposed leg parts disposed outwardly from a crown or bight on either side of a central axis, the leg parts having tapered sides and adapted to intermesh with each other when clinched about two or more aligned metal members, such as spaced or adjoining tapes, abutting the crown, the improvement in that said crown, on the interior thereof, is provided with means extending transversely across said crown and defining a planar surface for abutting lateral edges of said adjoining tapes.

BRIEF DESCRIPTION OF THE DRAWINGS

The invention will now be described with reference to the accompanying drawings, wherein.

DESCRIPTION OF A PREFERRED EMBODIMENT

Figure 3:
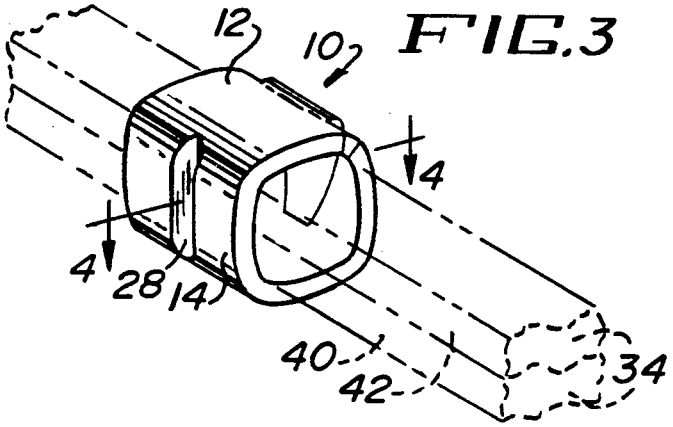
FIG. 3 shows a U-shaped clip clinched about a pair of longitudinal members.

As shown in the Figures of the drawings, a U-shaped clip 10 has a body 12 having a crown 14 terminating in a pair of spaced leg parts 16 and 18, wherein leg part 18 is provided with tapered sides 20 and adapted to interengage with leg part 16 having tapered sides 22 defining therebetween an angled notch 24 for intermeshing with leg part 18.

An exterior surface 26 of the crown 14 has an indentation 28 centrally located in the body 12 and transversely extending along the crown 14. In forming the indentation 28, a locking rib 30 is formed on the interior surface 32 of the crown 14.

The function of the U-shaped clip, as shown FIG. 3, is to clinch together a pair of spaced or adjoining longitudinal metal members 34 and to prevent longitudinal movement and lateral movement between the adjoining metal members 34.

Figure 5:
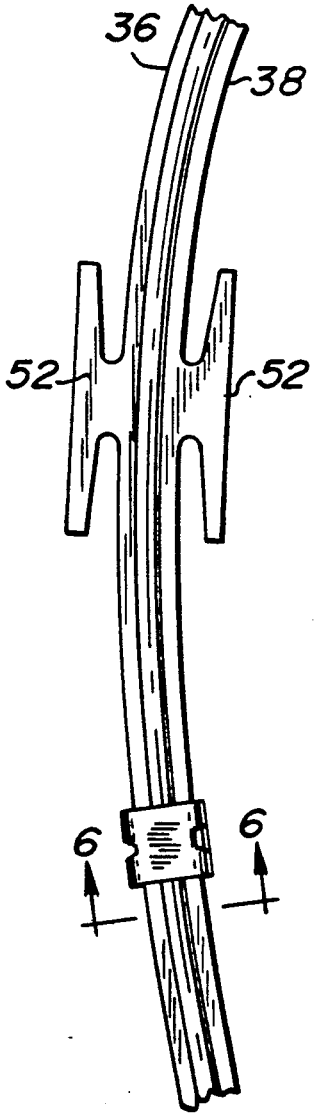
FIG. 5 is a side view of U-shaped clip clinched around a pair of metal tapes provided with cutting members.

The U-shaped clip 10 has been particularly developed for use with long barbed tapes which are generally arranged to provide perimeter fence about installations seeking ultimate security. In particular, the U-shaped clips are used in manufacturing concertina barbed tapes, as briefly illustrated in FIGS. 5 and 6. A pair of adjoining barbed tapes 36 and 38 which have corresponding lateral sides or edges 40 and 42, respectively, are rigidly secured by the locking rib 30 to prevent longitudinal and lateral movements between the barbed tapes 36 and 38. Each barbed tape, such as 36, comprises an elongated tape member 44 which is clinched about a rod member 46. Other lateral sides or edges 48 and 50 are secured in a spaced relationship by the leg parts 16 and 18. Along the length of the elongated metal members 44, the lateral sides or edges are provided with extending razor-sharp members 52.

Figure 6:
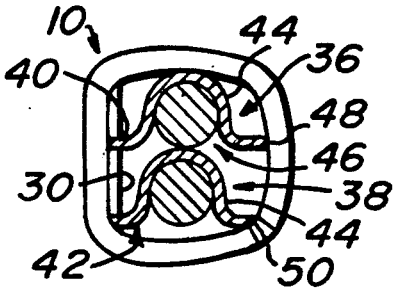
FIG. 6 is a sectional view taken along the lines 6—6 of FIG. 5.

As shown in FIG. 3, the U-shaped clip is clinched about a pair of adjoining elongated members 34, whereas the view in FIG. 6 shows the U-shaped clip clinched about spaced members 44 with their corresponding lateral edges 40 and 42 abutting the locking rib 30.

Figure 4:
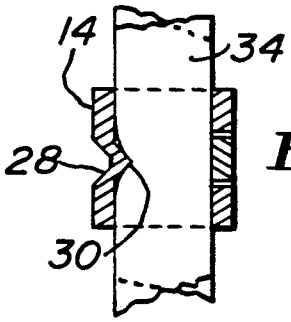
FIG. 4 is a sectional view along the lines 4—4 of FIG. 3.
Figure 2:
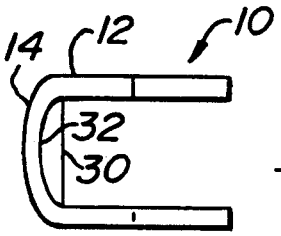
FIG. 2 shows a side view of a U-shaped clip, rotated 90°, to show spaced legs.
Figure 1:
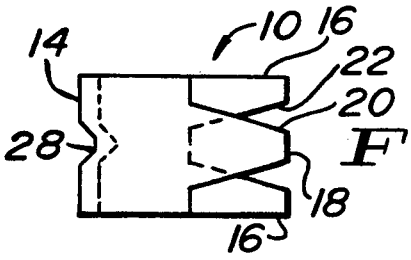
FIG. 1 shows a side view of a U-shaped clip.

As shown in FIG. 4, and in FIG. 6, the locking rib 30 indents into the elongated members 34 and 44. However, this is not necessary since the locking rib 30 applies sufficient force to the lateral edges 40 and 42 to prevent longitudinal and lateral movements between the members 34, and between tapes 36 and 38.

Variations and modifications in the details of structure and arrangement of the parts may be resorted to within the spirit and coverage of the appended claims.

What is claimed is:

1. A U-shaped clip having opposed leg parts disposed outwardly from a crown or bight on either side of a central axis, the leg parts having tapered sides adapted to intermesh with each other when clinched about two or more aligned metal members, such as spaced or adjoining tapes, abutting the crown, the improvement in that said crown, on the interior thereof, is provided with means extending transversely across said crown and defining a planar surface for abutting lateral edges of said aligned tapes, wherein said means extending transversely across the interior of said crown is an aligning rib formed by an indentation extending transversely across the exterior of said crown, and wherein said aligning rib, cross-sectionally, defines a V-shape which, at its apex, defines said planar surface.

2. A U-shaped clip for clamping abutting helical coils, each being formed from an elongated flat metal strap having a pair of lateral edges, said clip having opposed legs extending from a crown, one leg forming a pair of transversely-spaced prongs defining a tapered space therebetween, the other leg terminating in a medial spring having a configuration to be intermeshed with said pair of transversely spaced prongs, the improvement in that said crown, on the interior thereof, is provided with an aligning rib formed by an indentation extending transversely completely across the exterior of said crown, said aligning rib extending between said legs and defining a lineal edge adapted for aligning said lateral edges when said prongs are intermeshed about said abutting flat metal strips.

3. A U-shaped clip according to claim 2, wherein said lineal edge has a V-shape terminating in an apex adapted to align said lateral edges of said flat metal strips.

* * * * *